US009052108B2

(12) United States Patent
Werle et al.

(10) Patent No.: US 9,052,108 B2
(45) Date of Patent: Jun. 9, 2015

(54) PREMIXING COMBUSTION DEVICE

(75) Inventors: Gerhard Werle, Frastanz (AT); Markus Telian, Hörbranz (AT); Günther Köb, Hard (AT)

(73) Assignee: Hovalwerk AG, Liechtenstein (AT)

( * ) Notice: Subject to any disclaimer, the term of this patent is extended or adjusted under 35 U.S.C. 154(b) by 166 days.

(21) Appl. No.: 13/189,930

(22) Filed: Jul. 25, 2011

(65) Prior Publication Data

US 2012/0021365 A1 Jan. 26, 2012

(30) Foreign Application Priority Data

Jul. 26, 2010 (EP) ..... 10170814

(51) Int. Cl.

*F23N 5/20* (2006.01)
*F23D 14/60* (2006.01)
*F23D 14/34* (2006.01)
(Continued)

(52) U.S. Cl.

CPC ..... *F23D 14/60* (2013.01); *F23N 2027/00* (2013.01); *F23C 2900/99006* (2013.01); *F23D 14/34* (2013.01); *F23L 3/00* (2013.01); *F23N 1/025* (2013.01); *F23N 2027/02* (2013.01); *F23N 2035/06* (2013.01)

(58) Field of Classification Search

CPC . F23D 14/60; F23N 2027/00; F23N 2027/02; F23N 2027/10
USPC ..... 431/6, 62, 12
See application file for complete search history.

(56) References Cited

U.S. PATENT DOCUMENTS 2,039,431 A * 5/1936 Macnerland ..... 110/104 R
2,603,411 A 7/1952 Trumpa
2,693,913 A * 11/1954 Antl et al. ..... 236/1 E
(Continued)

FOREIGN PATENT DOCUMENTS

DE 1501894 10/1969
DE 4316315 12/1994
(Continued)

OTHER PUBLICATIONS

Baade, Peter K and Tomarchio, Michael. 'Tricks and Tools for Solving Abnormal Combustion Noise Problems'. Noise-Con 2008, 12 pages, Jul. 28-30, 2008.*
(Continued)

*Primary Examiner* — Kenneth Rinehart
*Assistant Examiner* — Gajanan M Prabhu
(74) *Attorney, Agent, or Firm* — Rankin, Hill & Clark LLP

(57) ABSTRACT

In a premixing combustion device (1) for a heating boiler, comprising a blower (2) which delivers a combustion mixture composed of fuel and air from an outlet opening (8) of the blower (2) via a burner cylinder (9) to a combustion zone, wherein a mixing device (3) arranged upstream of the blower (2) prepares the combustion mixture, it is sought to provide a solution which, in a structurally simple manner, ensures reliable starting of the heating boiler and prevents failures. This is achieved by means of a throughflow reduction device (10) which is arranged between the outlet opening (8) of the blower (2) and the burner cylinder (9) and which has a throughflow reduction element (13) which can be adjusted between a position in which it opens the outlet opening (8) of the blower (2) and a position in which it reduces the size of the outlet opening (8) of the blower (2).

19 Claims, 2 Drawing Sheets

Figure 1:
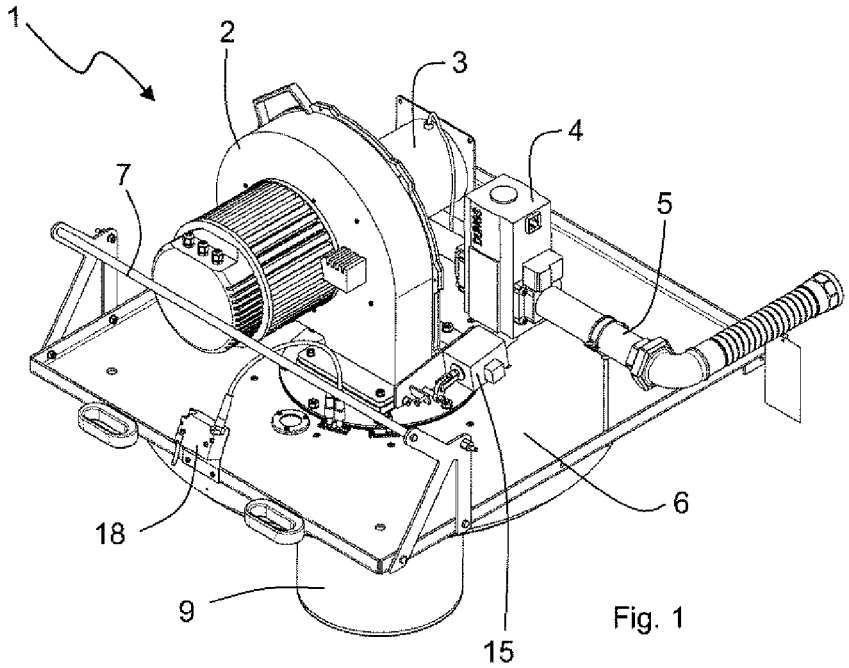

(51) Int. Cl.

| | |
|---|---|
| ***F23L 3/00*** | (2006.01) |
| ***F23N 1/02*** | (2006.01) |

(56) References Cited

U.S. PATENT DOCUMENTS

| | | | | | |
|---|---|---|---|---|---|
| 4,177,716 | A * | 12/1979 | Bowe et al. | 454/50 |
| 4,184,837 | A * | 1/1980 | Manning | 431/90 |
| 4,262,652 | A * | 4/1981 | Butzen | 126/285 B |
| 4,451,227 | A * | 5/1984 | Landis et al. | 431/18 |
| 4,944,098 | A * | 7/1990 | Hella et al. | 34/640 |
| 5,056,500 | A * | 10/1991 | Evens | 126/110 R |
| 5,441,405 | A * | 8/1995 | Bedford et al. | 431/286 |
| 5,685,240 | A * | 11/1997 | Briggs et al. | 110/106 |
| 5,993,195 | A * | 11/1999 | Thompson | 431/19 |
| 6,206,687 | B1 * | 3/2001 | Redington | 431/90 |
| 6,249,100 | B1 * | 6/2001 | Lange | 318/471 |
| 6,382,959 | B2 * | 5/2002 | Turk et al. | 431/12 |
| 6,619,951 | B2 * | 9/2003 | Bodnar et al. | 431/329 |
| 6,718,889 | B1 * | 4/2004 | Brazier et al. | 110/234 |
| 6,887,073 | B1 * | 5/2005 | Ruffolo | 431/159 |
| 6,979,965 | B2 * | 12/2005 | McMillan et al. | 318/160 |
| 2001/0036608 | A1 * | 11/2001 | Turk et al. | 431/12 |
| 2002/0189681 | A1 * | 12/2002 | Linthorst | 137/487.5 |
| 2008/0216772 | A1 * | 9/2008 | Gordon et al. | 122/18.3 |
| 2009/0042152 | A1 * | 2/2009 | Tanaka et al. | 431/12 |

FOREIGN PATENT DOCUMENTS

| | | | | |
|---|---|---|---|---|
| DE | 4316315 | A1 * | 12/1994 | F23D 11/42 |
| DE | 20201184 | | 4/2002 | |
| EP | 0896191 | | 2/1999 | |
| EP | 1083386 | | 3/2001 | |
| EP | 1241409 | | 9/2002 | |
| EP | 1241409 | A2 * | 9/2002 | F23N 1/02 |
| GB | 1175787 | | 12/1969 | |
| GB | 2261063 | | 5/1993 | |
| JP | 02150614 | A * | 6/1990 | F23L 1/00 |
| JP | 04032610 | A * | 2/1992 | F23N 1/02 |

OTHER PUBLICATIONS

European Search Report dated Mar. 17, 2011.

Examination Report of Application No. 10/170814.7 dated Aug. 30, 2012.

Examination Report of Application No. 10/170814.7 dated Mar. 12, 2013.

* cited by examiner

PREMIXING COMBUSTION DEVICE

The invention relates to a premixing combustion device for a heating boiler, comprising a blower which delivers a combustion mixture composed of fuel and air from an outlet opening of the blower via a burner cylinder to a combustion zone, wherein a mixing device arranged upstream of the blower prepares the combustion mixture.

The invention also relates to a method for starting a premixing combustion device for a heating boiler, wherein a combustion mixture formed from fuel and air is prepared by a mixing device arranged upstream of a blower, and wherein proceeding from an outlet opening of the blower, the combustion mixture is delivered via a burner cylinder to a combustion zone.

Heating boilers having premixing combustion devices are known from the prior art and are used for warming up heating and/or service water in buildings and residential premises. In the operation of such conventional heating boilers, the hot combustion waste gases are conducted in heat exchanger pipes through the heating and/or service water situated in the heating boilers. Here, the combustion waste gas cools and ultimately condenses. In contrast to conventional heating boilers, in so-called condensing boilers, not only the heat of the combustion waste gases but also the heat of condensation of the water vapor in the combustion waste gas is utilized, as a result of which the energy content of the fuel used is utilized virtually completely.

In the abovementioned types of heating boilers, the starting of the combustion device constitutes a particularly critical phase in which problems can arise with regard to the ignition of the combustion mixture. It is generally known, in the case of a combustion device operated with combustion gas, to reduce the air fraction during a starting phase such that the combustion mixture which is oversaturated with fuel can be reliably ignited. Furthermore, the prior art discloses regulators with which, during a starting phase of the combustion device, the air quantity is reduced and/or the fuel quantity is increased, wherein said process is repeated cyclically, with simultaneous variation of the combustion gas mixture, until reliable ignition takes place. The measures for reducing the air fraction and/or for increasing the fuel fraction serve primarily the purpose of making it possible to operate a heating boiler in continuous operation with the lowest possible pollutant levels, wherein the measures may also be used during the starting phase of heating boilers.

The disadvantage of the known measures is accordingly that the combustion mixture is always immediately set to the value of a demanded setpoint heating power, and the setpoint air fraction is reduced or the setpoint gas fraction is increased during the starting phase, such that an increased discharge of pollutants occurs. Furthermore, the ignitable combustion mixture flows into a combustion zone abruptly during the starting phase, such that the ignition constitutes a step into load operation. Said process leads to undesired pressure surges or pulsations in the combustion chamber of the heating boiler and can lead to failures of the combustion device.

The object on which the invention is based is that of providing, in the case of a premixing combustion device of the type mentioned in the introduction, a solution which, in a structurally simple manner, ensures reliable starting of the heating boiler and prevents failures.

In the case of a premixing combustion device of the type mentioned in the introduction, said object is achieved according to the invention by means of a throughflow reduction device which is arranged between the outlet opening of the blower and the burner cylinder and which has a throughflow reduction element which can be adjusted between a position in which it opens the outlet opening of the blower and a position in which it reduces the size of the outlet opening of the blower.

Likewise, the above object is achieved in the case of a method of the type mentioned in the introduction in that, at the same time as the starting of the combustion device, a throughflow reduction element, which is arranged between the outlet opening of the blower and the burner cylinder, of a throughflow reduction device is moved from a position in which it opens the outlet opening of the blower into a position in which it reduces the size of the outlet opening of the blower.

Advantageous and expedient embodiments and refinements of the invention will emerge from the subclaims.

The invention provides a facility with which reliable ignition of the combustion mixture in a premixing combustion device is ensured in a structurally simple manner. By means of the throughflow reduction element of the throughflow reduction device, it is possible, upon starting of the premixing combustion device, for the pressure and the speed of the combustion mixture flowing to the burner cylinder to be regulated or controlled by varying the cross section of the outlet opening of the blower so as to yield conditions for reliable ignition. On account of the possibility of regulating or controlling the ignition conditions, a "softer" or "smoother" start of the combustion device is possible, such that pulsations can be prevented in the starting phase. The regulation or control of the ignition conditions furthermore ensures reliable starting of the combustion device even in the case of adverse flue conditions in the waste gas duct.

Within the context of the invention, it was found that a higher blower pressure and a lower flow speed of the combustion mixture are expedient for a "softer" or "smoother" start of the combustion device and to avoid starting pulsations. This is achieved, in one embodiment of the combustion device according to the invention, in that, upon starting of the combustion device, the throughflow reduction element is arranged in the position in which it reduces the size of the outlet opening of the blower. Directly after ignition of the combustion mixture has taken place, the throughflow reduction element is moved into the position in which it opens the outlet opening of the blower, and remains in said position during the operation of the combustion device.

In one embodiment of the combustion device according to the invention, it is provided that, when the throughflow reduction element is in the position in which it reduces the size of the outlet opening of the blower, the cross section of the outlet opening which remains free amounts to 15% to 45% of the cross section of the outlet opening when the throughflow reduction element is in the open position. The invention likewise provides, in a refinement of the method, that when the throughflow reduction element is in the position in which it reduces the size of the outlet opening of the blower, the cross section of the outlet opening which remains free is reduced in size to 15% to 45% of the cross section of the outlet opening when the throughflow reduction element is in the open position. The cross section of the outlet opening of the blower is accordingly reduced in size by the throughflow reduction element, specifically by 55% to 85% of the actual cross section of the outlet opening. The cross section of the outlet opening of the blower which remains free is preferably reduced to 30%, as a result of which a higher blower pressure and a lower flow speed of the combustion mixture are obtained in the combustion zone.

In one embodiment of the combustion device according to the invention, the invention provides that the throughflow reduction element is a rotatably mounted flap element. In this way, it is possible for a variation of the throughflow cross section, through which the combustion mixture flows, of the outlet opening, and regulation or control of the ignition conditions, to be obtained in a structurally simple manner. The invention is however not restricted to a throughflow reduction element in the form of a flap element. In fact, a person skilled in the art will recognize that alternative embodiments to this which effect a variation in the throughflow rate are conceivable. For example, the throughflow reduction element could also be designed as a shut-off slide.

During operation of the premixing combustion device or of the heating boiler, the throughflow reduction element is in the position in which it opens the outlet opening of the blower. In order that said position of the throughflow reduction element is ensured during ongoing heating boiler operation, the invention provides, in one embodiment, that the throughflow device has a restoring element which imparts a force which forces the throughflow reduction element into the position in which it opens the outlet opening of the blower. Such a restoring element may for example take the form of a restoring spring by means of which the throughflow reduction element is preloaded or held pressed into the position in which it opens the outlet opening of the blower.

The throughflow reduction element is situated in the position in which it reduces the size of the outlet opening of the blower only in the starting phase of the combustion device or only during the ignition phase of the combustion mixture. In order that said position can be assumed by the throughflow reduction element, it is provided according to the invention that the throughflow reduction element has an electromagnet which is coupled to the combustion device such that, at the time of starting of the combustion device, the electromagnet moves the throughflow reduction element, counter to the force of the restoring element, from the position in which it opens the outlet opening of the blower into the position in which it reduces the size of the outlet opening of the blower. For this purpose, the electromagnet may for example be coupled to an ignition controller of the combustion device. The ignition controller provides that corresponding voltages can be applied in parallel, or simultaneously, both to an ignition transformer for activating the ignition electrode and also to the electromagnet, such that at the same time as the ignition, the electromagnet is activated so as to effect the change in the position of the throughflow reduction element. As a result of the joint and simultaneous activation of the ignition transformer and electromagnet by means of the ignition controller, it is ensured that the electromagnet moves the throughflow reduction element into the position in which it reduces the size of the outlet opening of the blower actually only during the starting phase of the combustion device. After a successful starting phase, there are no longer any voltages applied to the electromagnet and the ignition electrode, such that the force of the restoring element acting on the throughflow reduction element has the effect that the throughflow reduction element is moved back into, and held in, the position in which it opens the outlet opening of the blower.

Instead of an electromagnet, the throughflow reduction device may have some other suitable actuating means for varying the position or setting of the throughflow reduction element. For example, instead of an electromagnet, it would be possible to use an electric motor coupled to the ignition controller or a pneumatic actuating means coupled to the ignition controller, which electric motor or pneumatic actuating means moves the throughflow reduction element from the position in which it opens the outlet opening of the blower into the position in which it reduces the size of the outlet opening of the blower and back only during the ignition phase. In a refinement of the method, the invention provides that, after the starting of the combustion device, that is to say after a successful starting phase or successful ignition of the combustion mixture, the throughflow reduction element is moved from the position in which it reduces the size of the outlet opening of the blower into the position in which it opens the outlet opening of the blower. The reduction in size of the outlet opening of the blower is accordingly a measure implemented only at the time of the starting process. Once the combustion mixture has been ignited, the entire or actual cross section of the outlet opening of the blower is opened up again.

It is self-evident that the features mentioned above and the features yet to be explained below can be used not only in the respectively specified combination but rather also in other combinations or individually without departing from the scope of the present invention. The scope of the invention is defined only by the claims.

Figure 2:
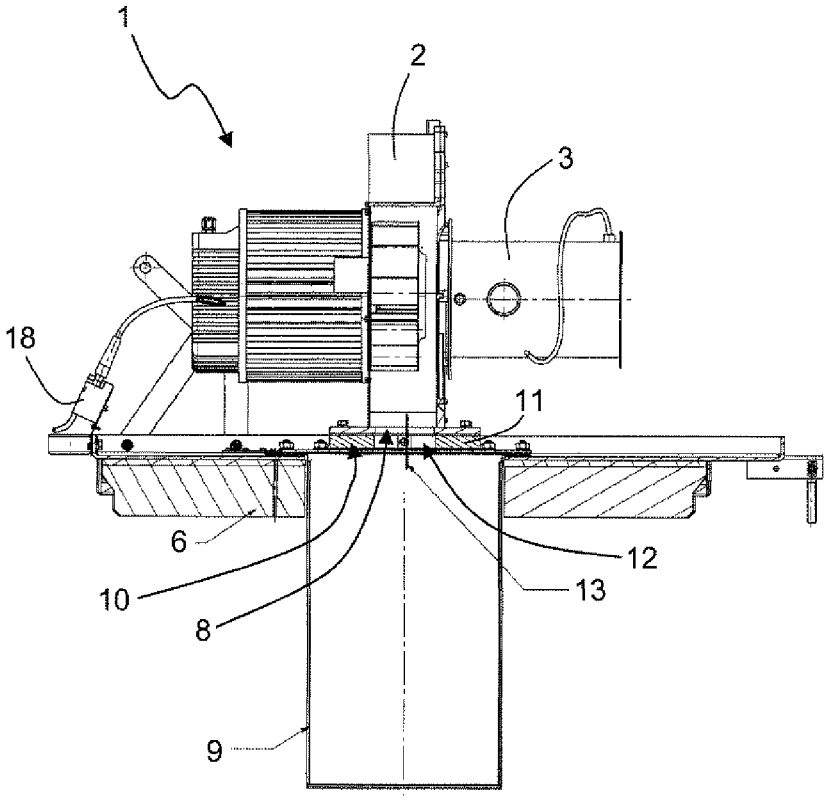
Figure 3:
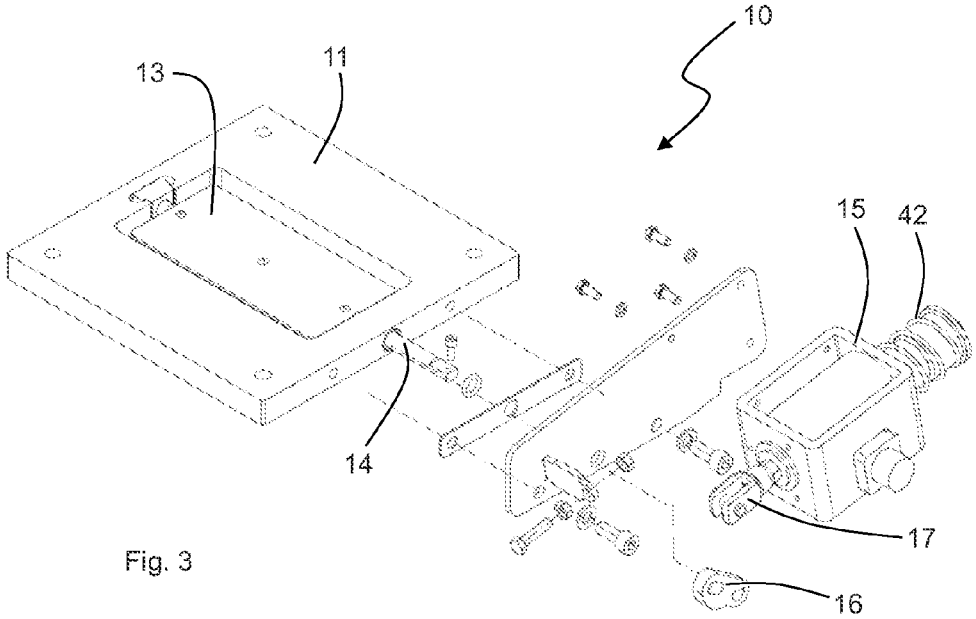
Figure 4:
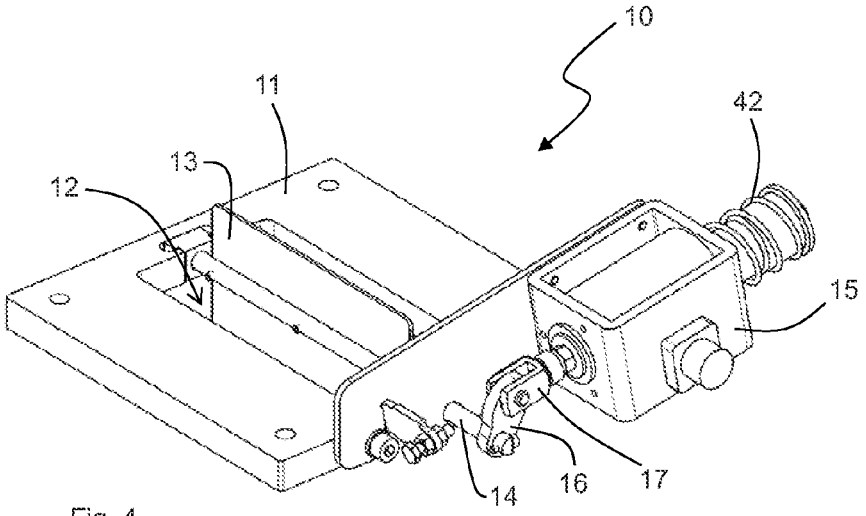

Further details, features and advantages of the subject matter of the invention will emerge from the following description in conjunction with the drawing, in which a preferred exemplary embodiment of the invention is illustrated by way of example. In the drawing:

FIG. 1 shows a premixing combustion device according to the invention in a perspective illustration, FIG. 2 shows the premixing combustion device according to the invention in a side view, FIG. 3 shows a detailed partial illustration of a throughflow reduction device, and FIG. 4 shows the throughflow reduction device in the assembled state.

A premixing combustion device 1, in FIGS. 1 and 2, for a heating boiler (not illustrated in any more detail) which may be designed as a condensing boiler comprises a blower 2 which delivers a combustion mixture composed of fuel (for example gas) and air to a combustion zone not shown in the figures. The blower 2 is mounted on a so-called burner door 6 which, for servicing and cleaning purposes, is held in a pivotable manner by means of a retaining device 7. The combustion mixture is prepared in a mixing device 3 which is arranged upstream of the blower 2 and through which the air or combustion air is delivered. Combustion gas is supplied to the air through a feed line 4 which opens out laterally into the mixing device 3, wherein the fraction of the gas can be adjusted by means of a valve 5. A homogenization of the combustion mixture is realized by means of intensive mixing within the blower 2.

The combustion mixture composed of combustion gas and combustion air passes via an outlet opening 8, which is not illustrated in any more detail in FIG. 2, of the blower 2 into a burner cylinder 9 which is arranged beneath the blower 2 and extends vertically thereunder. The combustion mixture situated in the burner cylinder 9 then passes radially out of the burner cylinder 9 through passage openings (not illustrated) of said burner cylinder 9 and flows into a combustion zone in which, in the starting phase of the combustion device 1, the combustion mixture is ignited by means of an ignition electrode radially spaced apart from the burner cylinder 9. Flame monitoring takes place, in the way known from the prior art, by means of an ionization electrode likewise arranged outside the burner cylinder 9.

According to the present invention, the premixing combustion device 1 also comprises a throughflow reduction device 10 which is arranged between the outlet opening 8 of the blower 2 and the burner cylinder 9. The throughflow reduction device 10 illustrated in more detail in FIGS. 3 and 4 comprises a slide-in plate 11 which is arranged between the outlet opening 8 of the blower 2 and the burner cylinder and which is fastened or mounted there on corresponding flange portions of the blower 2 and of the burner cylinder 9. The slide-in plate 11 has a passage opening 12 which corresponds to the cross section of the outlet opening 8 of the blower 2. A throughflow reduction element 13 in the form of a shut-off flap is arranged in the passage opening 12 of the slide-in plate 11. The throughflow reduction element 13 is connected to a drive shaft 14 for conjoint rotation therewith and is mounted, such that it can be rotated by means of the latter, in the passage opening 12 of the slide-in plate 11. By rotating the throughflow reduction element 13, the cross section through which the combustion mixture flows can be varied, as a result of which the pressure and speed of the combustion mixture flowing to the burner cylinder 9 can be regulated or controlled. A person skilled in the art will recognize that the throughflow reduction element may alternatively also be arranged and mounted directly in the outlet opening 8 of the blower 2, such that it would be possible to dispense with the slide-in plate 11.

The rotatably mounted throughflow reduction element 13 can be adjusted between a position in which it opens the outlet opening 8 of the blower 2 and a position in which it reduces the size of the outlet opening 8 of the blower 2. Here, the position of the throughflow reduction element 13 shown in FIG. 2 corresponds to the position in which it opens the outlet opening 8 of the blower 2. Said position is assumed by the throughflow reduction element 13 during actual operation of the combustion device 1, that is to say after the ignition of the combustion mixture. In contrast, in the starting phase of the combustion device 1, the throughflow reduction element 13 is arranged in the position in which it reduces the size of the outlet opening 8 of the blower 2, and in said position, reduces the cross section through which the combustion mixture flows.

It has been found that a reduction in size of the cross section of the outlet opening 8 of the blower 2 during the starting phase of the combustion device 1 or during the ignition phase of the combustion mixture causes an increase in the blower pressure and a reduction in the flow speed of the combustion mixture, which has an advantageous effect on the ignition of the combustion mixture situated in the combustion zone.

Accordingly, during the starting of the combustion device 1, the outlet opening 8 is blocked not completely but only partially by the throughflow reduction element 13. According to the invention, when the throughflow reduction element 13 is in the position in which it reduces the size of the outlet opening 8 of the blower 2, the cross section of the outlet opening 8 which remains free amounts to approximately 15% to 45% of the cross section of the outlet opening 8 when the throughflow reduction element 13 is in the open position. Here, the magnitude of the reduction of the cross section of the outlet opening 8 is dependent on the size or power of the heating boiler, wherein a reduction in size of the free-remaining cross section of the outlet opening 8 to approximately 30% of the cross section of the outlet opening 8 has proven to be particularly expedient during the starting phase of the heating boiler.

During the starting of the combustion device 1, the throughflow reduction element 13 is therefore arranged in the position in which it reduces the size of the outlet opening 8 of the blower 2. After successful ignition of the combustion mixture, the throughflow reduction element 13 is then turned into the position in which it opens the outlet opening 8 of the blower 2, such that the combustion mixture delivered by the blower 2 flows to the burner cylinder 9 substantially without hindrance from the throughflow reduction element 13, and the pressure and speed of the combustion mixture are determined exclusively by the blower 2.

The change in the position of the throughflow reduction element 13 into the position in which it opens the outlet opening 8 of the blower 2 is realized by means of a restoring element. The restoring element may for example take the form of a spring element 42 (FIGS. 3 and 4) which imparts a force which forces the throughflow reduction element 13 into the position in which it opens the outlet opening 8 of the blower 2. To turn or pivot the throughflow reduction element 13 into the position in which it reduces the size of the outlet opening 8 of the blower, the throughflow reduction device 10 has an electromagnet 15 which is arranged to the side of the blower 2 and which is coupled to the throughflow reduction device 10. The electromagnet 15 is connected via a lever mechanism 16 to an end, which projects out of the slide-in plate 11, of the drive shaft 14, and furthermore is coupled in terms of control to the combustion device 1 or the ignition controller thereof. Said coupling has the effect, upon ignition of the combustion mixture or upon starting of the combustion device 1, that a voltage is applied to the electromagnet 15 in parallel with the activation of the ignition electrode, as a result of which a fork head 17, which is coupled to the lever mechanism 16, of the electromagnet 15, which is designed in the manner of a lifting magnet, is moved. The parallel application of a voltage to the ignition electrode and to the electromagnet 15 may be realized for example by an ignition transformer 18 which is coupled to both components. When voltage is applied to the electromagnet 15, the movement of the fork head 17 is transmitted via the lever mechanism 16 to the drive shaft 14 and leads to a pivoting movement or rotation of the throughflow reduction element 13. As a result, the throughflow reduction element 13 is moved, counter to the force of the restoring element, from the position in which it opens the outlet opening 8 of the blower 2 into the position in which it reduces the size of the outlet opening 8 of the blower 2, as a result of which ultimately the free-remaining cross section of the outlet opening 8 of the blower is reduced. When the voltage for the ignition transformer is no longer provided, voltage is also no longer applied to the electromagnet 15. As a result, the restoring element forces the throughflow reduction element 13 into the position in which it opens the outlet opening 8 of the blower 2, such that the outlet opening 8 of the blower 2 is substantially opened up and the combustion mixture can flow through unhindered.

A person skilled in the art will recognize that, instead of an electromagnet, the throughflow reduction device may also have some other suitable actuating means which varies the position of the throughflow reduction element with signal and/or voltage dependency on the combustion device or the ignition controller thereof. For example, an electric motor or a pneumatic actuating means could be used for moving the throughflow reduction element designed as a flap element, wherein the activation of the electric motor or of the pneumatic actuating means may be coupled in terms of control to the combustion device 1 or the ignition controller thereof.

In the method according to the invention for starting the premixing combustion device 1 for a heating boiler, the combustion mixture formed from fuel or combustion gas and combustion air is prepared by the mixing device 3 arranged upstream of the blower 2. The prepared combustion mixture is then delivered by means of the blower 2 from the outlet opening 8 via the burner cylinder 9 to the combustion zone. Only during the starting phase of the combustion device 1 is the throughflow reduction element 13, which is arranged between the outlet opening 8 of the blower 2 and the burner cylinder 9, of the throughflow reduction device 10 moved from the position in which it opens the outlet opening 8 of the blower 2 into the position in which it reduces the size of the outlet opening 8 of the blower 2, wherein here, the cross section of the outlet opening 8 which remains free is reduced in size to 15% to 45%, preferably 30%, of the cross section of the outlet opening 8 when the throughflow reduction element 13 is in the open position. After the starting of the combustion device 1, the throughflow reduction element 13 is then moved from the position in which it reduces the size of the outlet opening 8 of the blower 2 into the position in which it opens the outlet opening 8 of the blower 2. In this way, pulsations during the starting phase of the heating boiler, which can otherwise lead to failures, can be prevented.

The invention described above is self-evidently not restricted to the embodiment described and illustrated. Numerous modifications which are obvious to a person skilled in the art in accordance with the intended application may be made to the illustrated embodiment without departing from the scope of the invention. Here, the invention includes all of that which is contained in the description and/or illustrated in the drawing, including that which, outside the specific exemplary embodiments, is obvious to a person skilled in the art.

The invention claimed is:

1. Premixing combustion device for a heating boiler, comprising a burner cylinder, a mixing device and a blower, wherein the blower delivers a combustion mixture composed of fuel and air from an outlet opening of the blower via the burner cylinder to a combustion zone, wherein the mixing device arranged upstream of the blower prepares the combustion mixture, and wherein a throughflow reduction device is arranged between the outlet opening of the blower and the burner cylinder and has a throughflow reduction element which can be adjusted between a position in which it opens the outlet opening of the blower and a position in which it reduces the size of the outlet opening of the blower, wherein, upon starting of the combustion device, the throughflow reduction element is arranged in the position in which it reduces the size of the outlet opening of the blower, and after the ignition of the combustion mixture, said throughflow reduction element is arranged in the position in which it opens the outlet opening of the blower, and wherein the throughflow reduction device is coupled to the premixing combustion device such that the throughflow reduction element is automatically moved from the position in which it opens the outlet opening of the blower into the position in which it reduces the size of the outlet opening of the blower during the ignition phase.

2. Premixing combustion device according to claim 1 wherein, when the throughflow reduction element is in the position in which it reduces the size of the outlet opening of the blower, the cross section of the outlet opening which remains free amounts to 15% to 45% of the cross section of the outlet opening when the throughflow reduction element is in the open position.

3. Premixing combustion device according to claim 2, wherein the throughflow reduction device has a restoring element which imparts a force which forces the throughflow reduction element into the position in which its opens the outlet opening of the blower.

4. Premixing combustion device according to claim 3, wherein the throughflow reduction device has an electromagnet which is coupled to the combustion device such that, upon starting of the combustion device, the electromagnet moves the throughflow reduction element counter to the force of the restoring element, from the position in which its opens the outlet opening of the blower into the position in which it reduces the size of the outlet opening of the blower.

5. Premixing combustion device according to claim 1, wherein the throughflow reduction element is a rotatably mounted flap element.

6. Premixing combustion device according to claim 5, wherein, when the throughflow reduction element is in the position in which it reduces the size of the outlet opening of the blower, the cross section of the outlet opening which remains free amounts to 15% to 45% of the cross section of the outlet opening when the throughflow reduction element is in the open position.

7. Premixing combustion device according to claim 5, wherein the throughflow reduction device has a restoring element which imparts a force which forces the throughflow reduction element into the position in which its opens the outlet opening of the blower.

8. Premixing combustion device according to claim 1, wherein the throughflow reduction device has a restoring element which imparts a force which forces the throughflow reduction element into the position in which its opens the outlet opening of the blower.

9. Premixing combustion device according to claim 8, wherein the throughflow reduction device has an electromagnet which is coupled to the combustion device such that, upon starting of the combustion device, the electromagnet moves the throughflow reduction element counter to the force of the restoring element, from the position in which its opens the outlet opening of the blower into the position in which it reduces the size of the outlet opening of the blower.

10. Premixing combustion device according to claim 8, wherein the throughflow reduction element is a rotatably mounted flap element.

11. Premixing combustion device according to claim 1, further including an electromagnet which is coupled to the combustion device such that, upon starting of the combustion device, the electromagnet automatically moves the throughflow reduction element, counter to the force of the restoring element, from the position in which its opens the outlet opening of the blower into the position in which it reduces the size of the outlet opening of the blower.

12. Premixing combustion device according to claim 1, wherein automatic movement of the throughflow reduction element is initiated or occurs substantially simultaneous with starting of the combustion device for increasing blower pressure and/or reducing the flow speed of the combustion mixture during the ignition phase.

13. Premixing combustion device according to claim 12, wherein the throughflow reduction element is automatically moved back from the position in which it reduces the size of the outlet opening of the blower to the position in which it opens the outlet opening of the blower immediately after or substantially simultaneous with successful ignition of the combustion mixture.

14. Method for starting a premixing combustion device for a heating boiler, comprising:

preparing a combustion mixture formed from fuel and air with a mixing device arranged upstream of a blower, delivering the combustion mixture from an outlet opening of the blower, via a burner cylinder to a combustion zone, starting the combustion device, at the same time as the starting of the combustion device, moving a throughflow reduction element, which is arranged between the outlet opening of the blower and the burner cylinder, of a throughflow reduction device from a position in which it opens the outlet opening of the blower into a position in which it reduces the size of the outlet opening of the blower.

15. Method according to claim 14, wherein, when the throughflow reduction element is in the position in which it reduces the size of the outlet opening of the blower, the cross section of the outlet opening which remains free is reduced in size to 15% to 45% of the cross section of the outlet opening when the throughflow reduction element is in the open position.

16. Method according to claim 15, wherein, after the starting of the combustion device, the throughflow reduction element is moved from the position in which it reduces the size of the outlet opening of the blower into the position in which it opens the outlet opening of the blower.

17. Method according to claim 14 wherein, after the starting of the combustion device, the throughflow reduction element is moved from the position in which it reduces the size of the outlet opening of the blower into the position in which it opens the outlet opening of the blower.

18. Method according to claim 14, wherein the throughflow reduction element is a rotatably mounted flap element.

19. Premixing combustion device for a heating boiler, comprising a burner cylinder, a mixing device and a blower, wherein the blower delivers a combustion mixture composed of fuel and air from an outlet opening of the blower via the burner cylinder to a combustion zone, wherein the mixing device arranged upstream of the blower prepares the combustion mixture, and wherein a throughflow reduction device is arranged between the outlet opening of the blower and the burner cylinder and has a throughflow reduction element which can be adjusted between a position in which it opens the outlet opening of the blower and a position in which it reduces the size of the outlet opening of the blower, wherein, upon starting of the combustion device, the throughflow reduction element is arranged in the position in which it reduces the size of the outlet opening of the blower, and after the ignition of the combustion mixture, said throughflow reduction element is arranged in the position in which it opens the outlet opening of the blower, and wherein the throughflow reduction device comprises an actuating means coupled to the premixing combustion device such that the actuating means automatically moves the throughflow reduction element from the position in which it opens the outlet opening of the blower into the position in which it reduces the size of the outlet opening of the blower during the ignition phase.

* * * * *